US007182351B2

(12) United States Patent
Williams

(10) Patent No.: US 7,182,351 B2
(45) Date of Patent: Feb. 27, 2007

(54) CRAWLING AID FOR HANDICAPPED INFANTS

(76) Inventor: Margaret Ellen Williams, 10815 Shagbark Trail, Roswell, GA (US) 30075

( * ) Notice: Subject to any disclaimer, the term of this patent is extended or adjusted under 35 U.S.C. 154(b) by 0 days.

(21) Appl. No.: 11/234,716

(22) Filed: Sep. 23, 2005

(65) Prior Publication Data

US 2006/0066067 A1 Mar. 30, 2006

Related U.S. Application Data

(60) Provisional application No. 60/613,929, filed on Sep. 29, 2004.

(51) Int. Cl.
*B25H 5/00* (2006.01)

(52) U.S. Cl. ..... 280/87.02; 280/32; 280/32.6; 280/87.01

(58) Field of Classification Search ..... 280/87.02, 280/32.6, 87.01, 32, 12; D12/128; D34/23
See application file for complete search history.

(56) References Cited

U.S. PATENT DOCUMENTS 1,432,612 A * 10/1922 O'Connor ..... 280/87.051
1,572,273 A * 2/1926 Elton ..... 280/87.051
2,246,648 A * 6/1941 Van Sittert et al. ..... 173/93.5
2,291,094 A * 7/1942 McCarthy ..... 280/32.6
3,044,797 A * 7/1962 Borland ..... 280/87.051
D213,370 S * 2/1969 Cherry ..... 280/87.051
3,532,356 A * 10/1970 Lillibridge ..... 280/87.051
3,905,054 A * 9/1975 Windsor et al. ..... 5/86.1
4,185,846 A * 1/1980 Black ..... 280/32.6
D261,378 S * 10/1981 Bergeron ..... 280/87.051
4,792,147 A * 12/1988 Wissing ..... 280/32.6
4,796,903 A * 1/1989 Proctor et al. ..... 280/87.051
D330,619 S * 10/1992 Gilbert et al. ..... D34/23

* cited by examiner

*Primary Examiner*—Christopher P. Ellis
*Assistant Examiner*—Cynthia F. Collado

(57) ABSTRACT

A crawling aid for infants having a partial disability provides a cushioned platform to support the body of the infant. The platform has wheels, including at least one caster, to render the platform maneuverable. Portions of the platform are narrow to allow the infant's good limbs to extend down and engage the floor; and, the head support allows the infant to see on both sides of the platform. Thus, the infant can execute crawling motion while body and disabled limbs are supported on the platform.

2 Claims, 2 Drawing Sheets

CRAWLING AID FOR HANDICAPPED INFANTS

CROSS REFERENCE TO RELATED APPLICATION

This application is a non-provisional application based on the co-pending provisional application filed Sep. 29, 2004, having application No. 60/613,929, titled "Crawling Aid for Handicapped Infants".

BACKGROUND OF THE INVENTION

1. Field of the Invention

This invention relates generally to aids for the handicapped, and is more particularly concerned with a crawling aid for infants having reduced use of one or more of their limbs.

2. Discussion of the Prior Art

Crawling is a typical part of early childhood development that commences between age 6 to 11 months, depending on the individual infant. Crawling continues until the infant becomes bipedal, which is normally around age 8–18 months. During this time, infants use crawling to interact independently with their environment and with their caregivers in order to perform certain critical physical, cognitive and psychosocial developmental tasks. These developmental tasks require that infants have opportunities to interact independently with their environment; otherwise the infant's development is hampered.

Infants with spina bifida have varying degrees of paralysis and sensory impairment of the lower extremities, which affects their ability to crawl. Physical problems common among children and adults with spina bifida include mobility problems related to their disability, obesity related to the lack of mobility and exercise, and lack of the upper body strength and fine motor dexterity which are typically promoted by the activity of crawling.

Cognitive deficits common among children with spina bifida include shortened attention span, problems with conceptual reasoning, and problems with receptive and expressive language development.

Psychosocial difficulties often observed in individuals with spina bifida include stubbornness, lack of initiative, lack of follow-through, dependency, and being manipulative of others. Other problems include problems with self-image and with community and peer acceptance, often resulting in behavior problems and cocktail party hyperverbality.

In summary, infants and children with spina bifida and certain other disabilities have problems related to lower extremity function which affect their ability to independently explore their environment, as do typically developing infants who crawl.

According to research on the plasticity of the infant brain, an infant's brain capacity is not genetically fixed at birth, but continues to develop after birth through an interplay of nature and nurture. Early intervention has been proven effective, but developmental timing is crucial as "time windows" exist during infant development when the infant's developing brain is especially efficient at certain types of learning. Also, human development occurs in stages that follow a structural and functional plan. These developmental stages are expected within given time frames, and growth within a specific stage is built on the successful completion of the previous developmental stages. When the infant's attempts at exploration and social interaction are restricted, the infant's physical, cognitive, and psychosocial development are hampered. Additionally, in adulthood, childhood learning disabilities tend to co-exist with other handicapping conditions including difficulties with interpersonal relationships, emotional well-being, behavioral problems, employment, and the ability to live independently. Thus, as children with spina bifida are living into adulthood, early intervention during the developmentally critical time of infancy can make a significant impact.

Devices have been proposed to assist infants and children to crawl. Such devices include either a small platform on wheels, or frames from which the child is suspended. However, none of these devices is appropriate to promote independent mobility and environmental exploration by the infant with spina bifida around the age of 6–18 months. Based on physical measurements of the typical infant, current mobility devices designed for children are too wide for a 6–18 month-old infant to be able to reach the floor at the side of the device, too short to provide for a place to rest the head or to protect the sensory impaired lower extremities when the infant backs up, too big to be easily maneuverable by a small infant or to provide for easy access for exploration of the environment, or lack the safety features (such as straps) important when mobilizing an infant with spina bifida age 6–18 months.

Consequently, infants with spina bifida and certain other disabilities move around their environment either by rolling or by using combat crawling to drag their body along the floor. Although such infants are independently mobile, these methods of mobility carry the potential for injury of skin due to friction or contact with hazardous surfaces. Additionally, because of the sensory impairment of the lower extremities, the infants with spina bifida may hurt themselves, yet not be aware of the injury.

Correspondingly, the use of infant seats, swings, highchairs and other similar devices restrict the infant's ability to move and to independently explore their environment; and, such devices interfere with floor time, which is critical for the development of infant gross motor skills and manipulative skills.

SUMMARY OF THE INVENTION

The present invention provides a crawling aid suited to the infant having reduced use of its lower body, including infants with spina bifida or other debilitating disease or condition. However, the crawling aid could be modified to be used by an infant with use of the lower body but not the upper body, or by an infant with use of the left side of the body but not the right side, or vice versa. The device of the present invention comprises a platform carried by a plurality of wheels, the platform being dimensioned such that a 6–18 month old infant can be received on the platform face down and can reach the floor with its hands. The length of the platform is such that the entire body is received on the platform. The platform preferably includes cushioning means to contribute to the comfort of the infant; and, an aesthetically attractive covering may be received over the cushioning means. A safety securing means preferably will hold the infant to the platform.

In one embodiment of the invention, the platform is shaped similarly to a paddle, one end to providing a narrow area for freedom of movement of the infant's arms, allowing the hands to reach the floor. The remainder of the platform is generally rectangular and of a width for full support of the body of the infant. The infant can therefore propel itself around the floor in spite of its disability, and in considerable safety.

BRIEF DESCRIPTION OF THE DRAWINGS

These and other features and advantages of the present invention will become apparent from consideration of the following specification when taken in conjunction with the accompanying drawings in which.

DETAILED DESCRIPTION OF THE EMBODIMENT

Referring now more particularly to the drawings and to that embodiment of the invention here presented by way of illustration, the crawling aid includes a platform 10 adapted to receive an infant thereon as shown in phantom at 11. The platform is narrower at the head end 12, which is at the left in FIGS. 1 and 2 of the drawings.

Figure 1:
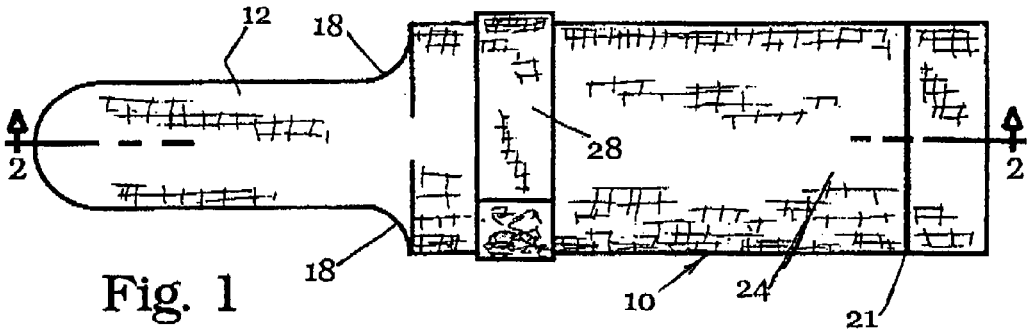
FIG. 1 is a top plan view of a crawling aid made in accordance with the present invention.

As is best seen in FIG. 1, the head end, or narrower portion 12 is for receiving the shoulders of an infant 11; and, the narrower portion 12 extends far enough to support the head of the infant at H.

Figure 2:
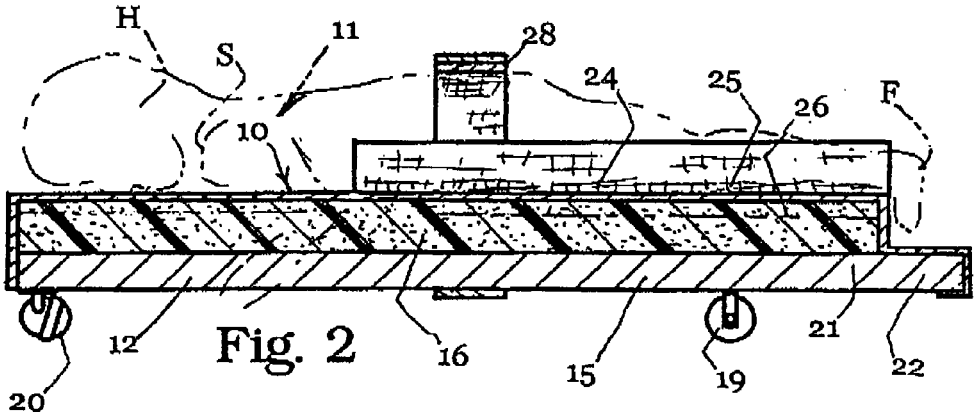
FIG. 2 is a longitudinal cross-sectional view taken along the line 2—2 in FIG. 1.
Figure 3:
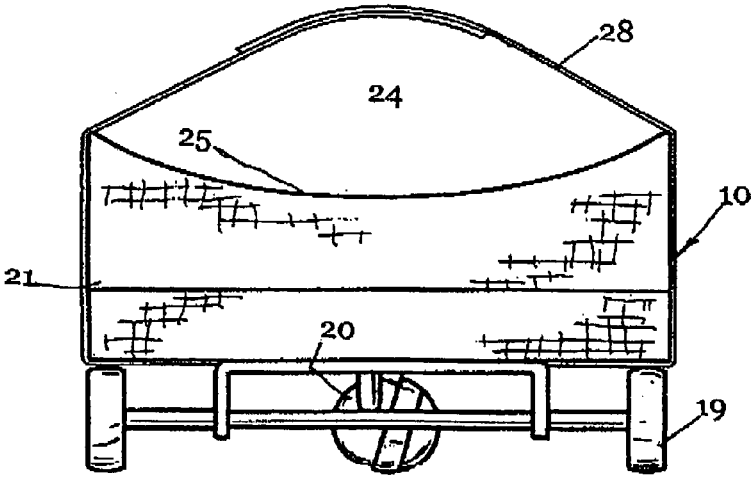
FIG. 3 is an enlarged rear elevational view of the device shown in FIGS. 1 and 2; and, FIG. 4 is an exploded perspective view showing the crawling aid of FIGS. 1–3.
Figure 4:
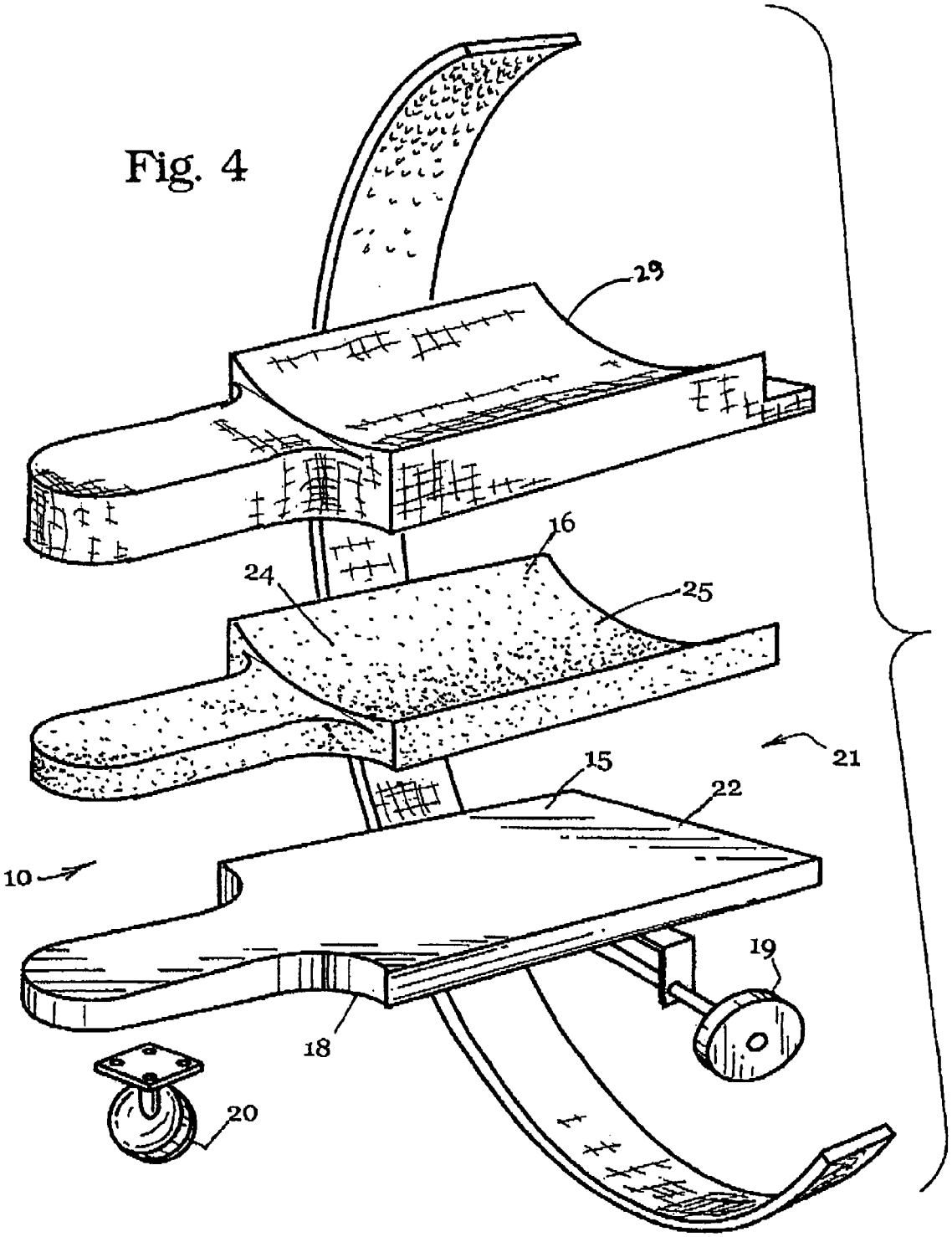

Looking at FIGS. 1 and 2, it will be seen that the platform 10 is made up of a base 15 and a cushion 16. The base 15 may be made of any generally rigid material. In a prototype, the base 15 is made of fibrous pressed board, but metal, plastics, wood and other materials will serve as well. The material must be strong enough to hold a small infant and not be easily damaged, yet lightweight for easy maneuverability, and numerous materials meet these criteria. The cushion 16, in the prototype, is made of foamed polyurethane, but many other cushioning materials will serve as well. Those skilled in the art will readily choose an appropriate material.

Thus, the base 15 and cushion 16 are generally the same size and shape, with one exception to be discussed hereinafter, and these make up the platform 10. It should be realized that the important feature of the narrower portion 12 of the platform 10 is to provide the proper width for support at the proper portion of the infant's anatomy. Thus, the shoulders S of the infant 11 are supported by the portion 12, but the portion 12 is narrow enough that the infant's arms can extend down so the infant's hands can contact the floor.

Towards the front of the narrower portion 12, the infant's head H is supported. Again, the portion 12 is wide enough to support the head comfortably, but narrow enough that the infant can see the surroundings. The combination of the freedom of movement of the hands and arms and the freedom of seeing the surroundings assists the infant's development of hand-eye coordination. It will be noticed that there are fillets 18 between the narrower portion 12 and the wider portion 16. It will be obvious that the outside corner of the wider portion could be rounded as well. Furthermore, if desired, the narrower portion could be tapered, to yield a shape similar to an ironing board. As the 6-month-old infant is 6–7 inches from axilla to axilla, in a preferred embodiment of the invention the narrower portion will be 6–7 inches wide. The shoulders S will be in this area, which allows for use of the arms. The rectangular portion will be 10–14 inches wide to provide for the infant's wider bottom and to promote stability of the platform. Those skilled in the art will realize that the dimensions can be varied to conform to the infant involved.

The base 15 has a plurality of wheel members fixed thereto. As shown, there are two rear wheels 19 and one front wheel 20, the front wheel 20 being a caster. It will be understood that one may prefer to use one or two casters towards the head end 12, and fixed wheels at the rear, or opposite, end 21. Having all wheels as casters allows a wide variety of motions, but the fixed-direction wheels provide better control for an infant having less than normal body function.

With particular attention to FIG. 2 of the drawings, it will be seen that the cushion 16 is shaped, in plan view, the same as the base 15, except that the cushion is somewhat shorter than the base 15. It should be noted that the infant's body 11 is fully received on the cushion 16, except that the feet F extend down, rearwardly of the cushion 16. It is also important to note that the rear end 22 of the base 15 extends beyond the cushion 16 so that the infant's feet F are within the confines of the base 15. As a result, if the infant backs up and contacts a wall, furniture or the like, the feet will be protected from injury. This is important for infants with spina bifida because, otherwise, the infant may sustain an injury yet not be aware that he is injured because of problems with feeling in the legs and feet. In a preferred embodiment of the invention, the distance from the shoulders S to where the feet extend down will be 13–18 inches. More cushioning will need to be added as the infant grows in order to continue to promote proper positioning of the feet. The base 15 will be 30–32 inches in length to provide for the addition of cushioning as the infant grows, yet still provide for protection of the feet.

The body receiving surface 24 of the platform 10 preferably defines a depression 25 for receiving the infant. The sloped sides of the depression will help prevent the infant from rolling out of the depression, and perhaps onto the floor. Depending on the infant, an infant may be more comfortable if the level of the cushion under the chest is higher than the level of the cushion under the hips. This variation in height of the cushion will place the infant at a slightly upward angle and allow for slight flexion of the hips. Such a lower surface is indicated by the broken line 26 in FIG. 2. Further, it is contemplated that a safety strap 28 will be provided. The strap 28 will encircle the infant, and the entire crawling aid, and will fasten to itself, e.g. by hook-and-loop fasteners. It will be understood that buckles, snaps and other fasteners will serve also, but the hook-and-loop fastener is simple and efficient.

The cushion 16, in the prototype device, is an expanded polymeric material such as polyurethane, which is preferred because of its light weight and cleanliness, but other cushioning means may be used if desired. Also, an egg-crate foam may be used to vary the surface firmness, or one may choose to use several layers of foams having different deflections. Other cushioning materials can achieve the same results.

Over the cushion 16 is a cover 29. The cover 29 is formed of a sheet material, perhaps a waterproof material to protect the cushion 16. Also, the cover 29 may be a printed material having bright colors and the like to attract the attention of an infant.

While not here shown, it will be understood that the cover 29 will be attached to the base 15 so the cover will not be inadvertently removed. Fastening means may include staples, hook-and-loop fasteners, snaps, a drawstring and other conventional fasteners.

It will of course be understood by those skilled in the art that the above described embodiment of the invention is by way of illustration only, and numerous changes and modifications may be made without departing from the spirit or scope of the invention as outlined in the appended claims.

The invention claimed is:

1. A crawling aid for partially disabled infants wherein such infants have reduced use of some of their limbs, said crawling aid comprising a platform for receiving the body of the infant, said platform including a head end and a rear end, wheel means for supporting said platform, said platform having a width sufficient to receive the body of an infant thereon, and at least one reduced width portion of said platform for allowing the arms of the infant to extend down and engage the floor, the arrangement being such that the infant can execute a crawling action with said arms of the infant while its body is supported on said platform, said platform including a head end and a rear end, said head end of said platform having such a width that the infant's shoulders can be received on said head end, and the arms of the infant can extend down on each side of said head end, said platform comprising a substantially rigid base and a cushion received on said base, so that the infant lies on said cushion, said cushion defining a depression therein for constraining the infant within said depression, said wheel means including at least one caster, said cushion being shaped the same as said base with the exception that said cushion is shorter at said rear end than said base, so that the feet of the infant will extend down from said cushion towards said base and be between said cushion and the rear end of said base, said wheel means further including a pair of fixed-direction wheels generally at one end of said base, with said caster at the opposite end of said base, said caster being substantially at said head end of said platform, and said fixed-direction wheels being substantially at said rear end of said platform, the length of said head end of said platform being of a length to receive the infant's head thereon, and having a width such that the infant can see on each side of said head end, and further including a strap encircling said crawling aid and the infant thereon for securing the infant to said crawling aid, and including a removable cover for said cushion on said platform.

2. A crawling aid for partially disabled infants, wherein such infants have reduced use of their legs, said crawling aid comprising a platform for receiving the body of the infant, said platform including a head end and a rear end, wheel means for supporting said platform, said platform having a width sufficient to receive the body of an infant thereon, a length at least sufficient to receive the entire body including legs thereon, and at least one reduced width portion of said platform for allowing the arms of the infant to extend down and engage the floor, the arrangement being such that the infant can execute a crawling action with said arms of the infant while its body is supported on said platform, and means for urging said body including legs of the infant to lie along the center of said platform so that the lower body is within the confines of said platform, and wherein said platform comprises a substantially rigid base and a cushion received on said base, so that the infant lies on said cushion, said cushion defining a depression therein as said means for urging said body of the infant to lie along the center of said platform, said wheel means including at least one caster, said cushion being shaped the same as said base with the exception that said cushion is shorter at said rear end than said base, so that the feet of the infant will extend down from said cushion towards said base and be between said cushion and the rear end of said base, said wheel means comprising a pair of fixed-direction wheels generally at said rear end of said base, with said caster at the opposite, or head, end of said base, the length of said head end of said platform being of a length to receive the infant's head thereon, and having a width such that the infant can see on each side of said head end, and further including a strap encircling said crawling aid and the infant thereon for securing the infant to said crawling aid, and including a removable cover for said cushion on said platform.

* * * * *